US007581806B2

(12) United States Patent
Niioka

(10) Patent No.: US 7,581,806 B2
(45) Date of Patent: Sep. 1, 2009

(54) PRINTER AND DETACHABLE PRINTER TRAY

(75) Inventor: Koji Niioka, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 306 days.

(21) Appl. No.: 11/560,488

(22) Filed: Nov. 16, 2006

(65) Prior Publication Data

US 2007/0109341 A1 May 17, 2007

(30) Foreign Application Priority Data

Nov. 17, 2005 (JP) ..... 2005-332447

(51) Int. Cl.
*B41J 29/393* (2006.01)

(52) U.S. Cl. ..... 347/19; 347/2; 347/101

(58) Field of Classification Search ..... 347/2–5, 347/9, 14, 19, 101, 153
See application file for complete search history.

(56) References Cited

U.S. PATENT DOCUMENTS

2004/0061757 A1* 4/2004 Yanagi et al. ..... 347/101

FOREIGN PATENT DOCUMENTS

JP 2005-178267 A 7/2005

* cited by examiner

*Primary Examiner*—Lam S Nguyen
(74) *Attorney, Agent, or Firm*—Workman Nydegger

(57) ABSTRACT

A liquid-ejecting apparatus includes a tray having a hole, a mark section provided in an area adjacent to the hole, a boundary section located between the hole and the mark section, a sensor detecting the boundary section, and a controller executing control of liquid ejection based on liquid ejection data. The liquid-ejecting apparatus determines a reference position in the hole on the basis of the boundary section and ejects liquid on the basis of information including the reference position.

4 Claims, 8 Drawing Sheets

PRINTER AND DETACHABLE PRINTER TRAY

BACKGROUND

1. Technical Field

The present invention relates to a printer and a detachable printer tray.

2. Related Art

JP-A-2005-178267 (see the section "Best Mode for Carrying Out the Invention") discloses a printer that prints on a medium like a Compact Disc-Recordable (CD-R) disc. In such a known printer that prints on a medium like a CD-R disc, the medium is placed on a tray that can be detachably mounted in the printer and the printer prints on the medium while moving the medium together with the tray.

Accordingly, in the known printer, before printing is performed, the medium placed on the tray is scanned with an optical sensor included in the printer and a center position of the medium is determined so as to adjust a print position. Therefore, an image can be printed on the medium without protruding or being displaced from the medium.

However, a threshold used in the known printer, that is, a threshold compared with a detection voltage obtained by the optical sensor to determine a detection voltage corresponding to the medium is set to a constant value in advance. Therefore, depending on the sensitivity of the optical sensor that differs for each printer, there is a risk that it will be difficult to detect the accurate position and the like of the medium.

For example, if the threshold largely differs from the middle value between the detection voltage obtained by the optical sensor at the medium and the detection voltage obtained by the optical sensor at the tray and the like and is close to one of the two detection voltages, the following problems will occur. That is, the printer will discriminate the medium from other objects with the threshold at a position where the voltage does not change suddenly in a detection voltage waveform obtained in the scanning process using the optical sensor. As a result, if the detection voltage waveform obtained in the scanning process using the optical sensor is influenced by noise, an area and a position of the medium determined on the basis of the threshold will vary, even when the noise level is low. Therefore, the reliability of the detected position of the medium is reduced and a print displacement easily occurs.

In addition, if the threshold is substantially equal to the detection voltage obtained by the optical sensor at the medium or the detection voltage obtained by the optical sensor at the tray and the like, it becomes difficult for the printer to recognize the medium with the threshold. As a result, it becomes difficult for the printer to adequately print on the medium.

Therefore, expensive sensors with uniform quality that have small differences in the sensitivity thereof or sensors having sensitivities within a predetermined range are used as the optical sensor for determining the position and the like of the medium on the tray.

SUMMARY

An advantage of some aspects of the invention is that a printer that can accurately eject liquid toward an object without being influenced by differences in detection performance between sensors can be provided.

According to an aspect of the invention, a liquid-ejecting apparatus includes a tray having a hole; a mark section provided in an area adjacent to the hole; a boundary section located between the hole and the mark section; a sensor detecting the boundary section; and a controller executing control of liquid ejection based on liquid ejection data. The liquid-ejecting apparatus determines a reference position in the hole on the basis of the boundary section and ejects liquid on the basis of information including the reference position.

In the liquid-ejecting apparatus, the hole may be rectangular and the reference position may be a center position of the hole.

In addition, in the liquid-ejecting apparatus, the boundary section may be determined on the basis of a threshold.

In addition, in the liquid-ejecting apparatus, the threshold may be calculated on the basis of a voltage obtained by the sensor at the boundary section.

In addition, in the liquid-ejecting apparatus, the threshold may be set such that the reference position can be accurately determined even if the voltage is influenced by noise.

In addition, in the liquid-ejecting apparatus, the threshold may be calculated by adding or subtracting a predetermined value to or from the voltage obtained by the sensor at the mark section.

In addition, in the liquid-ejecting apparatus, the predetermined value may vary in accordance with the voltage obtained by the sensor.

In addition, in the liquid-ejecting apparatus, the mark section may have a predetermined reflectance.

In addition, in the liquid-ejecting apparatus, a center position of an area for placing an object toward which the liquid is ejected may be determined on the basis of the information including the reference position.

In addition, in the liquid-ejecting apparatus, the object may be a CD-R disc or a DVD-R disc.

In addition, in the liquid-ejecting apparatus, a center position of the object toward which the liquid is ejected may be determined on the basis of the threshold.

Also in this case, the object may be a CD-R disc or a DVD-R disc.

The above-described liquid-ejecting apparatus may be a printer, and the liquid ejection data may be print data.

According to another aspect of the invention, a liquid-ejecting method includes detecting a position of a boundary section between a hole in a tray and a mark section provided in an area adjacent to the hole with a sensor; determining a reference position in the hole on the basis of the position of the boundary section; determining, on the basis of information including the reference position, a center position of an area for placing an object toward which liquid is ejected; determining, on the basis of information including the reference position, a center position of the object; calculating a distance between the center position of the area for placing the object and the center position of the object; ejecting the liquid such that the center of image data, on the basis of which the liquid is ejected toward the object, coincides with the center position of the area for placing the object if the distance is equal to or more than a predetermined distance; and ejecting the liquid such that the center of the image data coincides with the center position of the object if the distance is less than the predetermined distance.

In the liquid-ejecting method, the position of the boundary section may be determined on the basis of a threshold.

In addition, in the liquid-ejecting method, the center position of the object may be determined on the basis of the threshold.

In addition, in the liquid-ejecting method, the threshold may be calculated on the basis of a voltage obtained by the sensor at the boundary section.

In addition, in the liquid-ejecting method, the threshold may be set such that the reference position can be accurately determined even if the voltage is influenced by noise.

In addition, in the liquid-ejecting method, the threshold may be calculated by adding or subtracting a predetermined value to or from a voltage obtained by the sensor at the mark section.

In addition, in the liquid-ejecting method, the predetermined value may vary depending on the voltage of the sensor.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printer and a detachable printer tray according to an embodiment of the invention will be described below with reference to the accompanying drawings. In the following description of the printer and the detachable printer tray, a case in which a disc-shaped medium, such as a CD-R disc and a Digital Versatile Disk-Recordable (DVD-R) disc, is printed on will be explained as an example.

Figure 1:
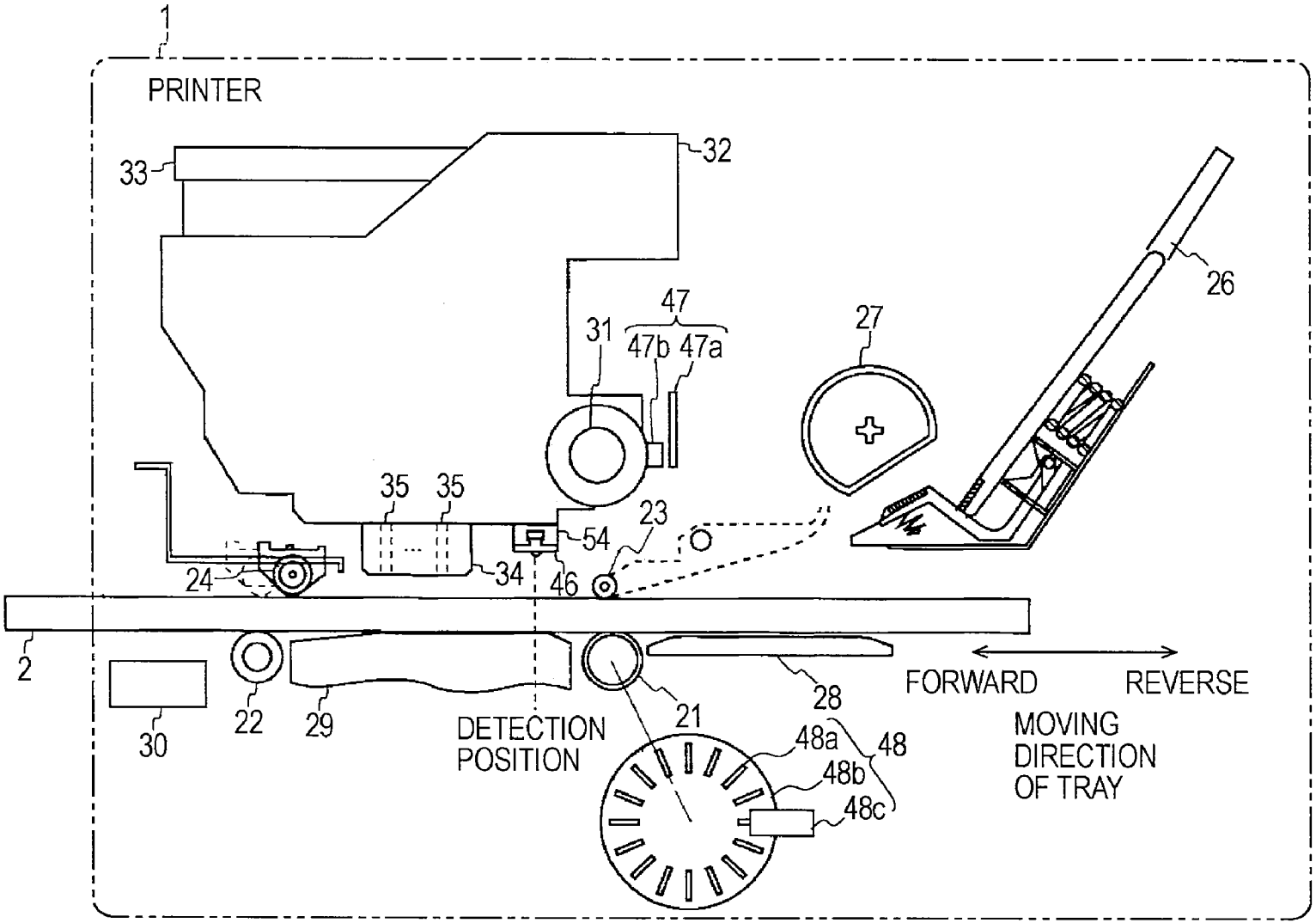
FIG. 1 is a diagram illustrating the basic structure of a printer according to an embodiment of the invention.
Figure 2:
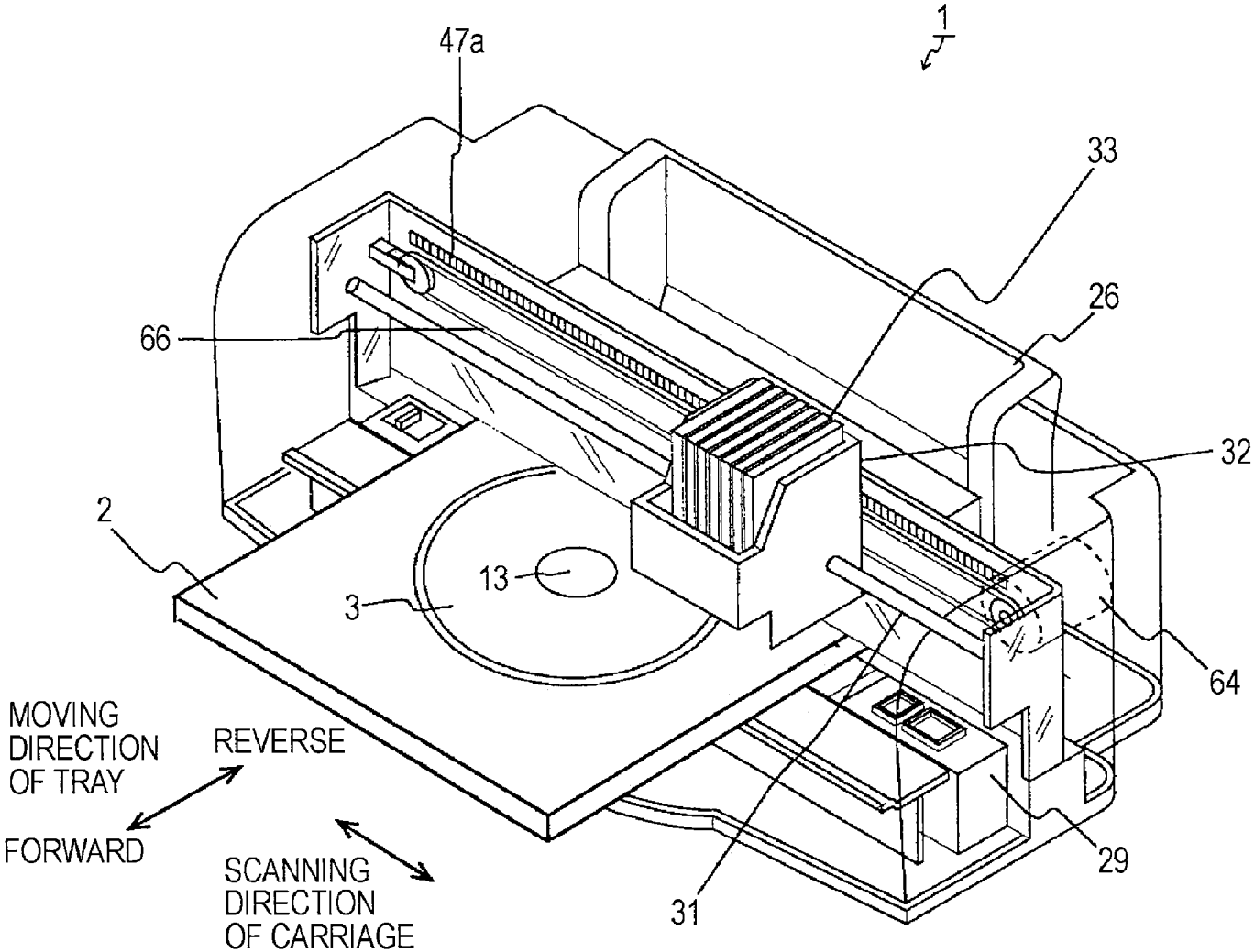
FIG. 2 is a partially see-through perspective view illustrating the basic structure of the printer shown in FIG. 1.

FIG. 1 is a diagram illustrating the basic structure of a printer 1 according to the embodiment of the invention. FIG. 2 is a partially see-through perspective view illustrating the basic structure of the printer 1 shown in FIG. 1. The printer 1 ejects ink toward a paper medium, a film medium, etc., to print thereon. In addition, the printer 1 is also capable of printing on a disc-shaped medium 3, such as a CD-R disc and a DVD-R disc.

Figure 3:
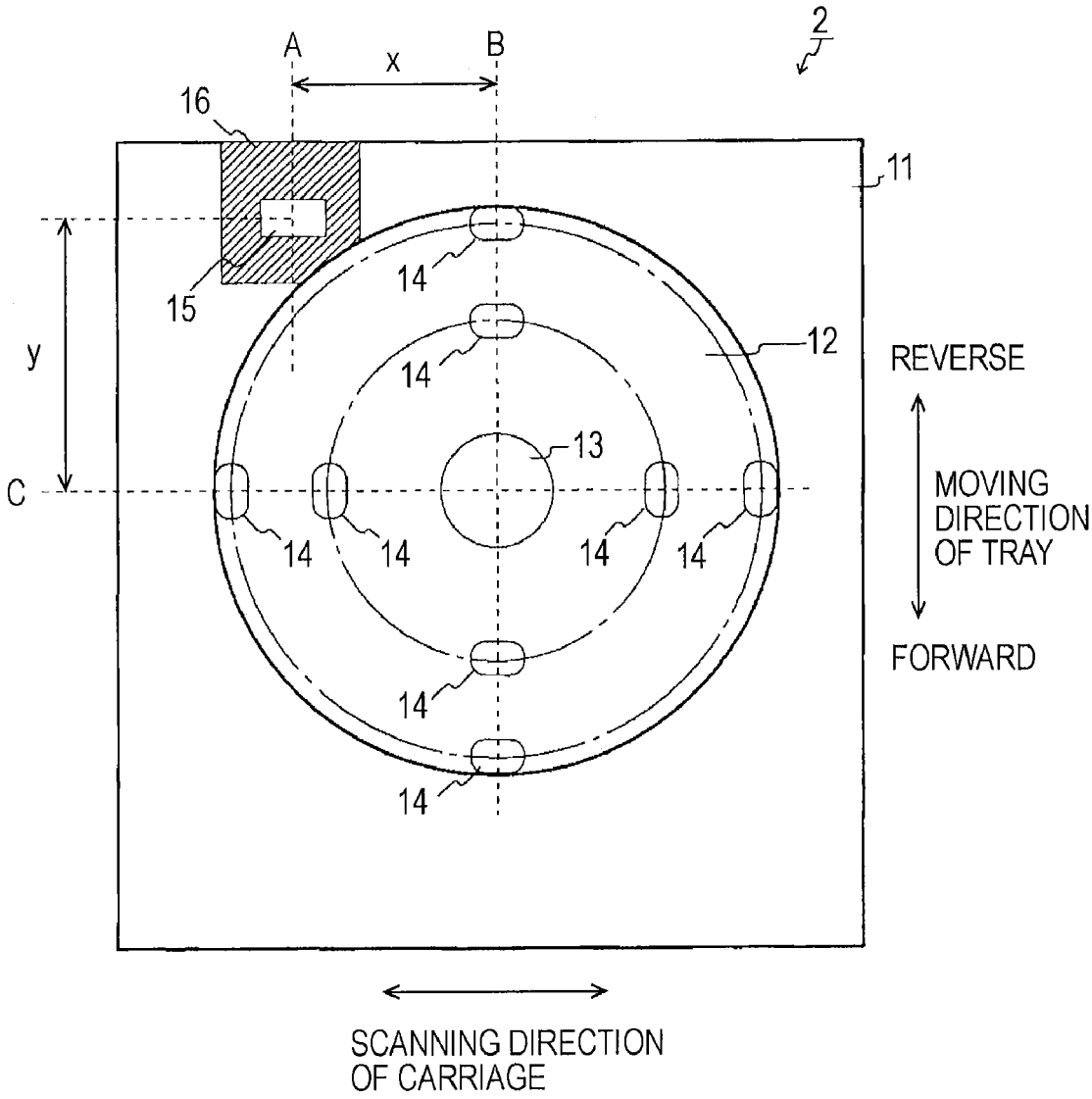
FIG. 3 is a front view of a CDR tray shown in FIG. 1.

FIG. 3 is a front view of a CDR tray 2 used in the printer 1 shown in FIG. 1 as a tray or a detachable printer tray. The CDR tray 2 can be detachably mounted in the printer 1 while the disc-shaped medium 3 is placed on the CDR tray 2.

As shown in FIG. 3, the CDR tray 2 includes a tray body 11. The tray body 11 is composed of a black, plastic material, and has a substantially rectangular plate shape. The width of the tray body 11 is set to, for example, the same width as that of a sheet of paper with the maximum printable size of the printer 1. The maximum printable size of the printer 1 is, for example, the 'A4' size or the 'B4' size.

The tray body 11 has a circular recess 12 in a front face at a central region thereof. The circular recess 12 is somewhat larger than the outer periphery of the disc-shaped medium 3 having a diameter of 12 cm (the larger one of two circles drawn with dot-dash lines in FIG. 3).

A chuck portion 13 that is concentric with the circular recess 12 projects from the circular recess 12 at the central region thereof. The chuck portion 13 has a columnar shape and is formed integrally with the tray body 11. The chuck portion 13 has substantially the same size as a center hole formed in the disc-shaped medium 3 having a diameter of 12 cm. The chuck portion 13 is fitted into the center hole in the disc-shaped medium 3 to retain the disc-shaped medium 3 on the tray body 11.

A plurality of elliptical through holes 14 are formed in the circular recess 12. In FIG. 3, eight of the elliptical through holes 14 are shown. Four of the eight elliptical through holes 14 shown in FIG. 3 are formed at positions coinciding with the outer periphery of the disc-shaped medium 3 having a diameter of 12 cm that is placed on the tray body 11. The other four elliptical through holes 14 are formed at positions coinciding with an outer periphery of a disc-shaped medium having a diameter of 8 cm that is placed on the tray body 11 (the smaller one of the two circles drawn with dot-dash lines in FIG. 3).

When the CDR tray 2 is in the position shown in FIG. 3, the vertical direction in FIG. 3 is referred to as a moving direction of the CDR tray 2 and the horizontal direction that is perpendicular to the vertical direction is referred to as a scanning direction of a carriage 32, which will be described below.

The four elliptical through holes 14 formed at positions coinciding with the outer periphery of the disc-shaped medium 3 having a diameter of 12 cm include two elliptical through holes 14 arranged in the moving direction of the CDR tray 2 and two elliptical through holes 14 arranged in the scanning direction of the carriage 32.

Similarly, the four elliptical through holes 14 formed at positions coinciding with the outer periphery of the disc-shaped medium having a diameter of 8 cm include two elliptical through holes 14 arranged in the moving direction of the CDR tray 2 and two elliptical through holes 14 arranged in the scanning direction of the carriage 32. The two elliptical through holes 14 arranged in the moving direction of the CDR tray 2 at positions coinciding with the outer periphery of the disc-shaped medium having a diameter of 8 cm, the two elliptical through holes 14 arranged in the moving direction of the CDR tray 2 at positions coinciding with the outer periphery of the disc-shaped medium 3 having a diameter of 12 cm, and the chuck portion 13 are aligned with one another. Similarly, the two elliptical through holes 14 arranged in the scanning direction of the carriage 32 at positions coinciding with the outer periphery of the disc-shaped medium having a diameter of 8 cm, the two elliptical through holes 14 arranged in the scanning direction of the carriage 32 at positions coinciding with the outer periphery of the disc-shaped medium 3 having a diameter of 12 cm, and the chuck portion 13 are aligned with one another.

A position detection hole 15 is formed in an upper left portion of the tray body 11 in FIG. 3. The position detection hole 15 has a rectangular shape. Four sides of the position detection hole 15 are substantially parallel to respective outer edges of the rectangular tray body 11. More specifically, one pair of opposite sides of the rectangular position detection hole 15 are substantially parallel to the moving direction of the CDR tray 2, and the other pair of opposite sides of the rectangular position detection hole 15 are parallel to the scanning direction of the carriage 32.

The position detection hole 15 is accurately positioned in the tray body 11 such that a predetermined distance relationship is established between the center of the position detection hole 15 and the center of the columnar chuck portion 13. Accordingly, a distance x and a distance y between the center of the position detection hole 15 and the center of the columnar chuck portion 13 in the scanning direction of the carriage 32 and the moving direction of the CDR tray 2, respectively, are determined with high accuracy.

A white mark section 16 (shown by hatching in FIG. 3), which functions as a mark section, is formed in an area surrounding the position detection hole 15 in the tray body 11 on the same side as the circular recess 12. The white mark section 16 is formed by applying, for example, white paint to the tray body 11. As shown in FIG. 3, the white mark section 16 expands from the top edge of the tray body 11 in FIG. 3 to the circular recess 12. The white mark section 16 has a reflectance of, for example, about 80%.

The CDR tray 2 shown in FIG. 3 is mounted in the printer 1 while the disc-shaped medium 3 is placed thereon, as shown in FIGS. 1 and 2. The printer 1 includes a tray-moving mechanism for moving the CDR tray 2 and an ink-ejecting mechanism for ejecting ink. In the following description, an area in which the ink is discharged toward the CDR tray 2 is called a print area.

The tray-moving mechanism includes a paper feed (PF) roller 21, a paper-ejecting roller 22, etc., for transporting the CDR tray 2 mounted in the printer 1. The PF roller 21 and the paper-ejecting roller 22 are disposed on the same horizontal plane in the printer 1.

The PF roller 21 is a columnar roller. A columnar driven roller 23 is disposed above the PF roller 21. The PF roller 21 and the driven roller 23 are separated from each other with a gap equal to or slightly smaller than the thickness of the CDR tray 2. The PF roller 21 and the driven roller 23 are rotatable about respective rotational axes extending in a direction substantially perpendicular to the page in FIG. 1.

Similar to the PF roller 21, the paper-ejecting roller 22 is also a columnar roller. A columnar driven roller 24 is disposed above the paper-ejecting roller 22. The paper-ejecting roller 22 and the driven roller 24 are separated from each other with a gap equal to or slightly smaller than the thickness of the CDR tray 2. The paper-ejecting roller 22 and the driven roller 24 are rotatable about respective rotational axes extending in a direction substantially perpendicular to the page in FIG. 1.

The printer 1 also includes a paper feed tray 26, a load (LD) roller 27, a paper guide 28, a platen 29, and a paper output tray 30.

The paper output tray 30 can move in a direction perpendicular to the direction in which a sheet of paper is transported in the printer 1. As shown in FIG. 1, when the paper output tray 30 is at an upper position, the paper guide 28, the PF roller 21, the platen 29, the paper-ejecting roller 22, etc., are moved downward due to a link mechanism (not shown). In this state, the CDR tray 2 can be mounted in the printer 1. When the paper output tray 30 is at a lower position, the paper guide 28, the PF roller 21, the platen 29, and the paper-ejecting roller 22 are moved upward and the PF roller 21 and the paper-ejecting roller 22 come into contact with the driven rollers 23 and 24, respectively. In this state, the CDR tray 2 cannot be mounted in the printer 1. The printer 1 causes the LD roller 27 and the PF roller 21 to transport a sheet of paper placed on the paper feed tray 26 to the print area, and causes the paper-ejecting roller 22 to eject the sheet of paper in the print area toward the paper output tray 30.

The ink-ejecting mechanism is disposed above the tray-moving mechanism having the above-described structure. The ink-ejecting mechanism mainly includes a carriage shaft 31, the carriage 32, an ink tank 33, and a recording head 34.

The carriage shaft 31 is a columnar shaft member. The carriage shaft 31 extends in a direction substantially perpendicular to the page in FIG. 1 at a position above the PF roller 21 and the driven roller 23.

The carriage 32 is retained by the carriage shaft 31 at a position above the platen 29. The carriage 32 can move along an axial direction of the carriage shaft 31.

The ink tank 33 is a container for containing liquid ink, and is detachably mounted on the carriage 32 at an upper section thereof. In the printer 1, four to eight colors of ink are generally used. The carriage 32 may carry either a plurality of ink tanks 33 provided for respective colors of ink or one or more ink tanks 33 that contain a plurality of colors of ink.

As shown in FIG. 1, the recording head 34 has a plurality of ink-ejecting nozzles 35. A piezoelectric element (not shown) is disposed in each of the ink-ejecting nozzles 35, and is deformed when a predetermined voltage pulse is applied thereto. The ink filling each ink-ejecting nozzle 35 is pushed out when the piezoelectric element is deformed, and is thereby ejected from the ink-ejecting nozzles 35. The ink is supplied to the ink-ejecting nozzles 35 from the ink tank 33.

The recording head 34 is disposed on the bottom surface of the carriage 32 so as to face the platen 29. Accordingly, the ink-ejecting nozzles 35 formed in the recording head 34 eject ink toward the platen 29. When the CDR tray 2 is placed between the recording head 34 and the platen 29, as shown in FIG. 1, the ink ejected from the ink-ejecting nozzles 35 lands on the disc-shaped medium 3 placed on the CDR tray 2. An area located between the platen 29 and the ink-ejecting nozzles 35 defines the print area.

Figure 4:
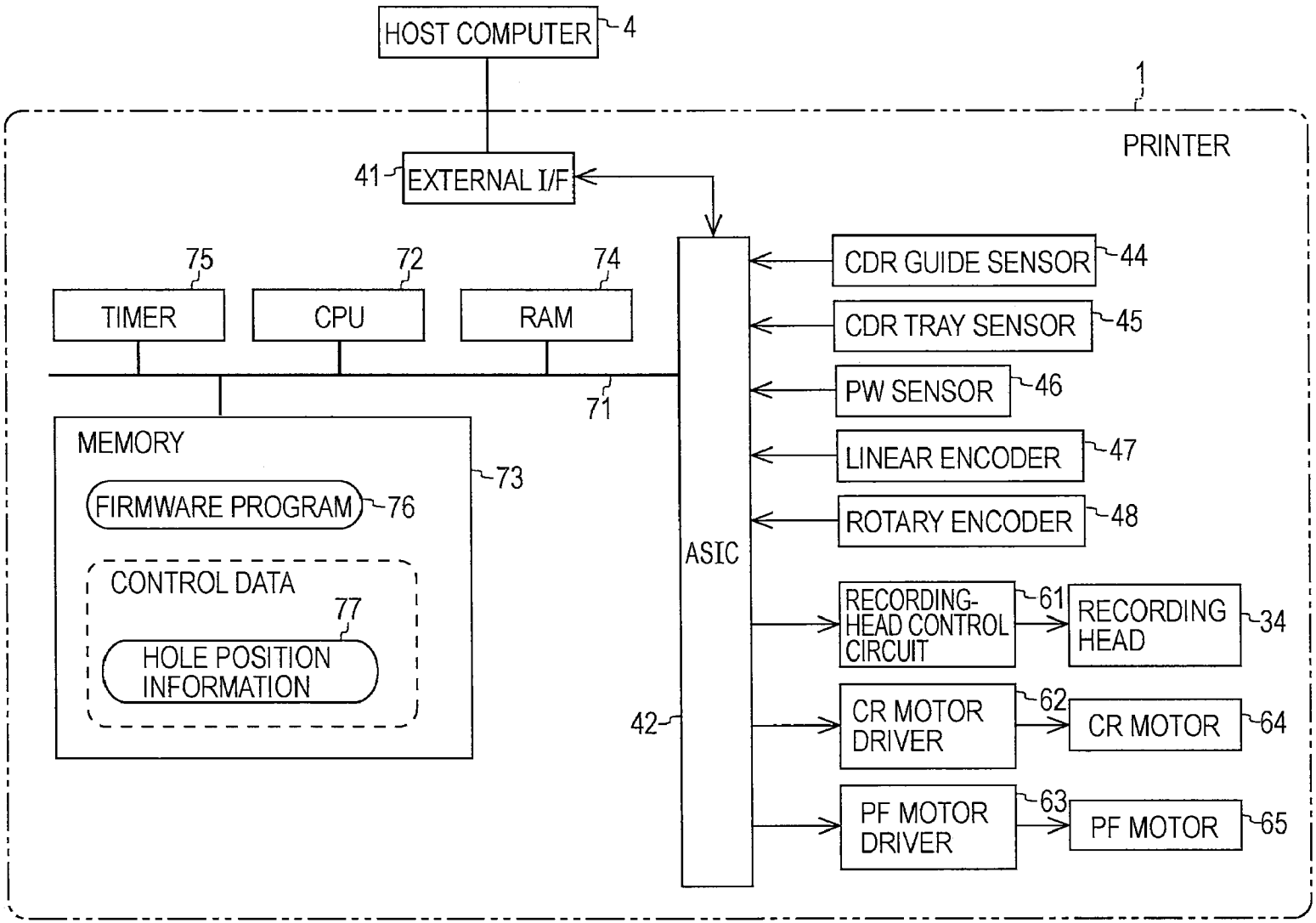
FIG. 4 is a diagram illustrating the hardware structure of a control system for controlling the printer shown in FIG. 1.
Figure 5:
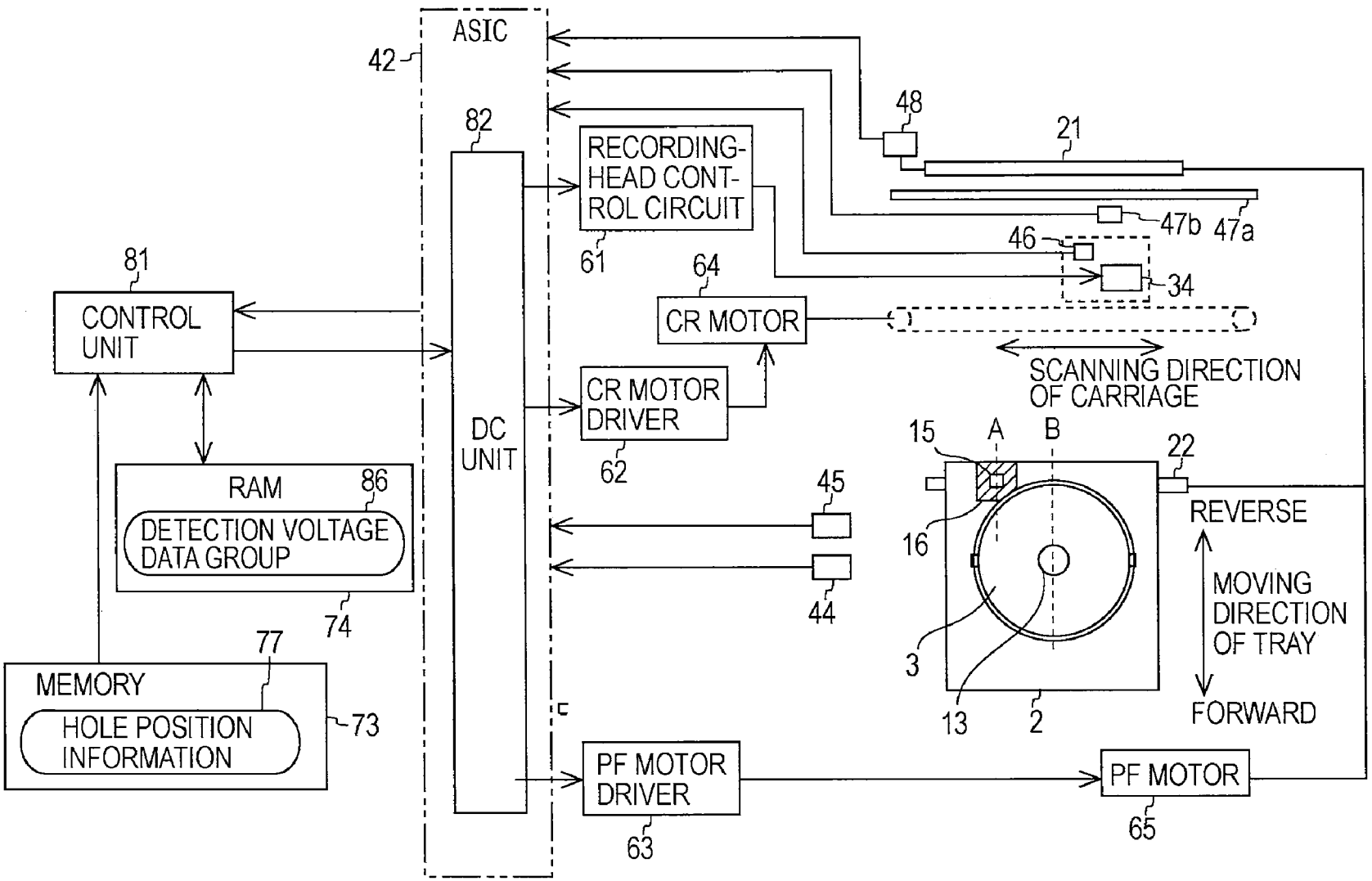
FIG. 5 is a block diagram of a control system implemented in the printer shown in FIG. 1.

FIG. 4 is a diagram illustrating the hardware structure of a control system for controlling the printer mechanism shown in FIG. 1. FIG. 5 is a block diagram of a control system implemented in the printer shown in FIG. 1.

The control system for controlling the printer 1 includes an external interface (I/F) 41 to which a host computer 4 is connected. The external I/F 41 includes a connector (not shown) connectable to, for example, a Universal Serial Bus (USB) cable, a printer cable, a Small Computer System Interface (SCSI) cable, etc. The external I/F 41 receives print data from the host computer 4 via the connector, the print data being used in the process of printing on the disc-shaped medium 3. The external I/F 41 may also be wirelessly connected to the host computer 4 by Bluetooth, wireless Local Area Network (LAN), etc.

The external I/F 41 is connected to an Application-Specific Integrated Circuit (ASIC) 42. The ASIC 42 includes a Central Processing Unit (CPU), a Random Access Memory (RAM), a programmable Read Only Memory (ROM), a timer, etc., which are not shown in the figure, and functions as a computer that performs a predetermined operation in accordance with a program stored in the programmable ROM.

The ASIC 42 has an Input/Output (I/O) port, an Analog-to-Digital Converter (ADC), a Digital-to-Analog Converter (DAC), etc., which are not shown in the figure. The I/O port is used for inputting and outputting digital signals. The ADC performs sampling of an input signal waveform with a predetermined sampling period. The DAC outputs a signal with a level that varies in accordance with a set value with a predetermined sampling period.

The I/O port included in the ASIC 42 is connected to a CDR guide sensor 44 that detects whether or not the printer 1 is in a CDR print mode, a CDR tray sensor 45 that detects the CDR tray 2 mounted in the printer 1, a paper wide (PW) sensor 46 that functions as an optical sensor for scanning the CDR tray 2, a linear encoder 47, and a rotary encoder 48. The I/O port may also be connected to a paper feed (PF) sensor for detecting the sheet of paper fed to the print area from the paper feed tray 26.

The CDR guide sensor 44 is disposed near the paper output tray 30. The CDR guide sensor 44 outputs a detection signal that varies in accordance with a vertical movement of the paper output tray 30 to the ASIC 42.

The CDR tray sensor 45 is disposed near the platen 29 and the paper-ejecting roller 22. The CDR tray sensor 45 outputs a detection signal that changes depending on whether or not the CDR tray 2 is mounted in the printer 1 to the ASIC 42.

Figure 6:
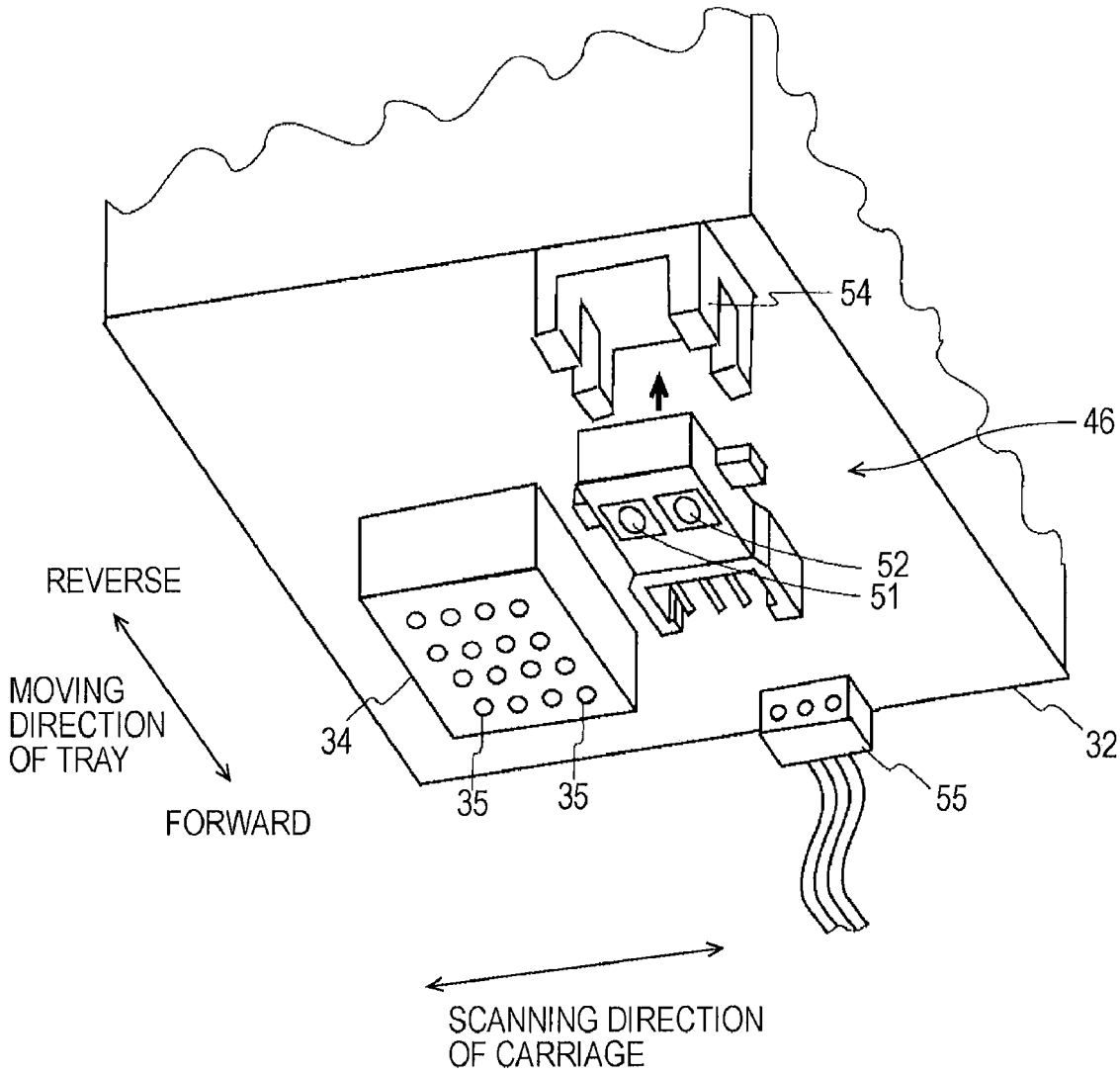
FIG. 6 is an enlarged perspective view illustrating a PW sensor and a part of a carriage shown in FIG. 1.

FIG. 6 is an enlarged perspective view illustrating the PW sensor 46 and a part of the carriage 32 shown in FIG. 1. FIG. 6 is obtained when the bottom surface of the carriage 32 is viewed from the platen 29. In FIG. 6, the forward moving direction of the CDR tray 2 is a direction from the upper left toward the lower right, and the carriage 32 moves in a direction toward the lower left and a direction toward the upper right.

The PW sensor 46 includes a light-emitting element 51 and a light-receiving element 52 and is structured such that the light-emitting element 51 and the light-receiving element 52 are resin-molded. Since the light-emitting element 51 and the light-receiving element 52 are resin-molded, the life and reliability of the PW sensor 46 can be increased compared to the case in which, for example, the PW sensor 46 is formed by soldering the light-emitting element 51 and the light-receiving element 52 on a substrate.

The PW sensor 46 is arranged on the bottom surface of the carriage 32 by being retained by a holder 54 that is fixed to the bottom surface of the carriage 32 in advance. The light-emitting element 51 and the light-receiving element 52 included in the PW sensor 46 face downward. The light-receiving element 52 outputs a light-receiving signal that varies in accordance with an amount of received light to the I/O port included in the ASIC 42 via a connector 55 provided on the main body.

As described above, the PW sensor 46 is retained by the holder 54 that is positioned and fixed on the bottom surface of the carriage 32 in advance. Therefore, differences in the arrangement position of the PW sensor 46 can be reduced. In addition, the light-emitting element 51 and the light-receiving element 52 of the PW sensor 46 are integrally formed by resin molding and are positioned with high accuracy. The detection position of the PW sensor 46 accurately coincides with a designed detection position.

As shown in FIGS. 1 and 2, the linear encoder 47 includes an elongate reflection plate 47*a* on which white and black stripes are repeatedly printed along the length thereof and a reflective optical sensor 47*b* having a light-emitting element and a light-receiving element arranged next to each other. The reflection plate 47*a* is arranged in the printer 1 so as to extend along the carriage shaft 31, and the reflective optical sensor 47*b* is disposed on the carriage 32 such that the light-emitting element and the light-receiving element face the reflection plate 47*a*. The light-receiving element receives light emitted by the light-emitting element and reflected by the reflection plate 47*a*. When the carriage 32 moves, the light-receiving element outputs a light-receiving signal that digitally changes in accordance with the white and black stripes on the reflection plate 47*a* to the I/O port included in the ASIC 42.

The rotary encoder 48 includes a circular plate 48*b* in which a plurality of slits 48*a* are formed along the outer circumference thereof and a transmissive optical sensor 48*c* having a light-emitting element and a light-receiving element that face each other with a small gap therebetween. The circular plate 48*b* rotates together with the PF roller 21. The light-receiving element of the rotary encoder 48 receives light when one of the slits 48*a* is placed between the light-light-emitting element and the light-receiving element, and does not receive light when the circular plate 48*b* itself (area between the adjacent slits 48*a*) is placed between the light-emitting element and the light-receiving element. When the PF roller 21 rotates, the light-receiving element outputs a light-receiving signal that digitally changes in accordance with the arrangement intervals between the slits 48*a* to the I/O port included in the ASIC 42.

As shown in FIG. 4, the ASIC 42 is connected to a recording-head control circuit 61, a carriage (CR) motor driver 62, a PF motor driver 63, etc. The recording-head control circuit 61 applies a voltage to the piezoelectric elements disposed in the ink-ejecting nozzles 35 in the recording head 34. Accordingly, ink is ejected from the recording head 34. The CR motor driver 62 rotates a CR motor 64. The CR motor 64 rotates a rotating belt 66 (see FIG. 2) to which the carriage 32 is fixed. When the CR motor 64 rotates, the carriage 32 moves. The PF motor driver 63 rotates a PF motor 65. The PF motor 65 rotates the LD roller 27, the PF roller 21, and the paper-ejecting roller 22. A DC motor, a pulse motor, etc., may be used as the CR motor 64 and the PF motor 65. The DC motor and the pulse motor can be rotated in both forward and reverse directions.

The ASIC 42 is also connected to a system bus 71. The system bus 71 is connected to a CPU 72, a memory 73, a RAM 74, a timer 75 for measuring time, etc., which are different from those included in the ASIC 42. The CPU 72, the memory 73, the RAM 74, and the timer 75 may either be provided as individual chips or be integrated in a single chip.

The memory 73 stores a firmware program 76, control data, etc. The firmware program 76 and the like may either be stored in the memory 73 before the printer 1 is shipped or be stored in the memory 73 after the printer 1 is shipped. When the firmware program 76 is stored in the memory 73 after the printer 1 is shipped, the firmware program 76 to be stored can be read out from a computer-readable recording medium, such as a CD-ROM, or be downloaded via a transmission medium, such as a telecommunication line. In addition, the firmware program 76 stored in the memory 73 may also be partially updated after the printer 1 is shipped.

The control data includes, for example, hole position information 77. The hole position information 77 represents the information of a relative distance between the position detection hole 15 and the chuck portion 13 provided on the CDR tray 2. This distance information includes, for example, information of distance in the scanning direction of the carriage 32 (the distance x in FIG. 3) and information of distance in the moving direction of the CDR tray 2 (the distance y in FIG. 3).

The CPU 72 reads out the firmware program 76 stored in the memory 73 into the RAM 74 and executes the firmware program 76. Accordingly, as shown in FIG. 5, a control unit 81 that functions as a threshold setter, a medium position detector, and a tray position detector is implemented in the printer 1.

The control unit 81 executes print control based on print data. The control unit 81 outputs various control commands to a direct current (DC) 82 unit implemented in the ASIC 42.

The DC unit 82 includes, for example, the DAC, the I/O port, etc., of the ASIC 42 and generates various signals to be fed to the recording-head control circuit 61, the CR motor driver 62, and the PF motor driver 63. The DC unit 82 updates the signals output to the CR motor driver 62, the PF motor driver 63, etc., with a predetermined short time period (e.g., several tens of micrometers).

Next, the operation of the printer 1 having the above-described structure will be described below.

When the printer 1 is started, the DC unit 82 and the control unit 81 are implemented in the printer 1, as shown in FIG. 5.

To print on the disc-shaped medium 3, a user sets the paper output tray 30 to the upper position. Accordingly, the PF roller 21 and the paper-ejecting roller 22 are moved away from the driven rollers 23 and 24, respectively. Then, the user places the disc-shaped medium 3 onto the CDR tray 2 and mounts the CDR tray 2 into the printer 1 from a side adjacent to the paper-ejecting roller 22. As shown in FIGS. 1 and 2, the CDR tray 2 is mounted in the printer 1 by being held between the paper-ejecting roller 22 and the driven roller 24 and between the PF roller 21 and the driven roller 23. In this state, the CDR guide sensor 44 outputs a detection signal indicating that the paper output tray 30 is at the upper position to the ASIC 42, and the CDR tray sensor 45 outputs a detection signal indicating that the CDR tray 2 is mounted to the ASIC 42.

The external I/F 41 included in the printer 1 receives print data from the host computer 4 connected to the external I/F 41, the print data being used in a process of printing on the disc-shaped medium 3. Accordingly, the control unit 81 of the printer 1 starts the printing process based on the print data.

The host computer 4 generates a donut-shaped print image that is to be printed on the disc-shaped medium 3 having a predetermined shape, converts the print image into images for respective ink colors, performs a halftone process for each of the images for the respective ink colors, and rasterizes the halftone images for the respective ink colors. Then, the host computer 4 transmits the data obtained as a result of the rasterizing process to the printer 1 as the print data used in the process of printing on the disc-shaped medium 3.

Alternatively, the host computer 4 may transmit, for example, data of an image to be printed and print conditions, such as the kind and size of the disc-shaped medium 3, to the printer 1. In such a case, the ASIC 42 in the printer 1 generates the print data after the rasterizing process using the received image data and print conditions.

When the preparation for printing is finished, the control unit 81 receives the detection signals obtained by the PW sensor 46, the linear encoder 47, the rotary encoder 48, etc., from the ASIC 42 and determines, on the basis of the received detection signals, whether or not the printer 1 can perform the printing process. In addition, the control unit 81 also determines, on the basis of the detection signals obtained by the CDR guide sensor 44 and the CDR tray sensor 45, whether or not the printer 1 can print on the disc-shaped medium 3.

Figure 7:
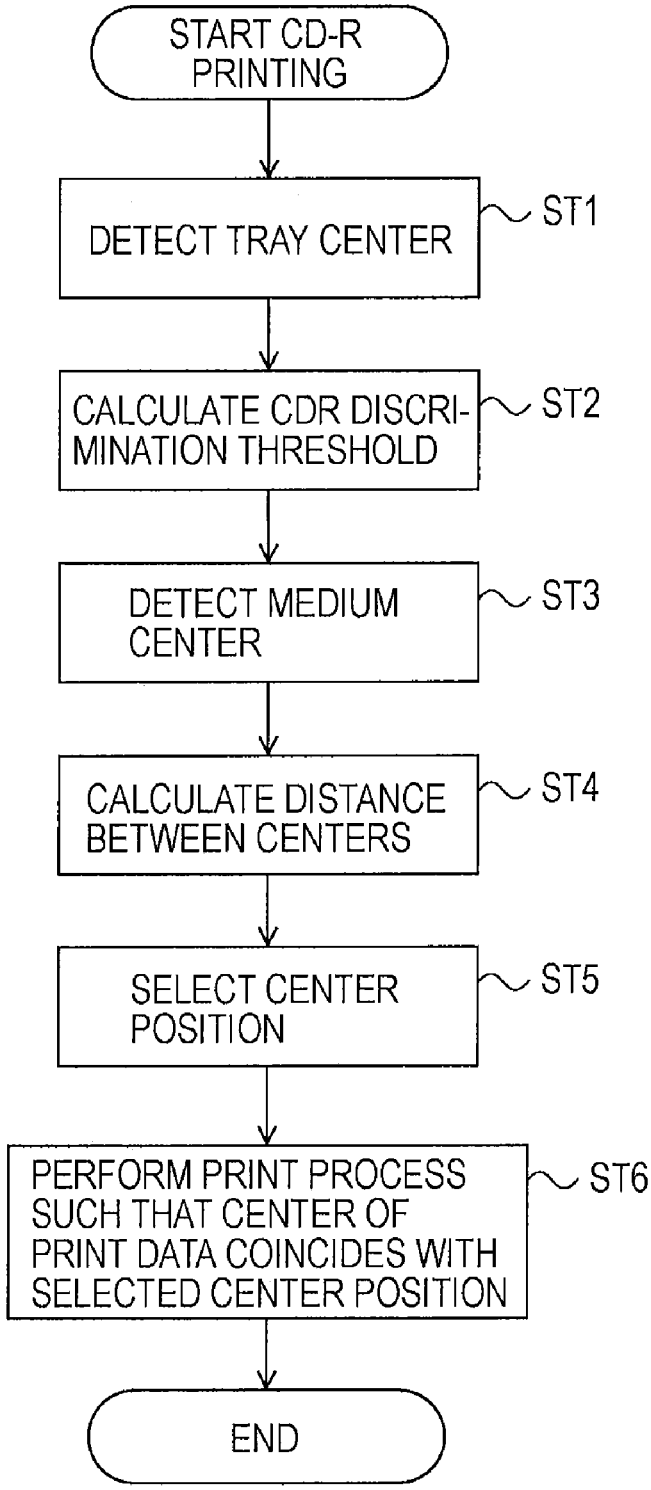
FIG. 7 is a flowchart illustrating a process of printing on a disc-shaped medium.

FIG. 7 is a flowchart illustrating the printing process performed by the control unit 81 shown in FIG. 5 to print on the disc-shaped medium 3.

When the printer 1 is in the state such that the printer 1 can print on the disc-shaped medium 3, first, the control unit 81 performs a step of detecting a center position of the CDR tray 2 (Step 1).

The center position of the CDR tray 2 is the position of the center of the columnar chuck portion 13, as shown in FIG. 3. The disc-shaped medium 3 is placed on the CDR tray 2 by fitting the chuck portion 13 into the center hole of the disc-shaped medium 3. Accordingly, the center of the chuck portion 13 generally coincides with the center of the disc-shaped medium 3.

In the step of detecting the tray center position, first, the control unit 81 commands the DC unit 82 to drive the CR motor 64. Accordingly, the DC unit 82 and the CR motor driver 62 rotate the CR motor 64. As the CR motor 64 rotates, the carriage 32 moves in the scanning direction. In the following direction, the moving direction of the carriage 32 is called a main-scanning direction and a direction in which the tray is moved is called a sub-scanning direction. The DC unit 82 and the CR motor driver 62 stop the CR motor 64 when the amount of movement reaches a predetermined distance. Accordingly, the PW sensor 46 reaches a position aligned with the center of the position detection hole 15 in the CDR tray 2, which is shown by 'A' in FIGS. 3 and 5, in the sub-scanning direction.

After the PW sensor 46 is positioned at the position shown by 'A' in the main-scanning direction as described above, the control unit 81 commands the DC unit 82 to drive the PF motor 65 in the reverse direction. Accordingly, the DC unit 82 and the PF motor driver 63 rotate the PF motor 65 in the reverse direction. As the PF motor 65 rotates in the reverse direction, the PF roller 21 and the paper-ejecting roller 22 also rotate in the reverse direction. Accordingly, the CDR tray 2 held between the paper-ejecting roller 22 and the driven roller 24 is moved in a direction from the paper-ejecting roller 22 to the PF roller 21, and is thereby pulled into the printer 1.

In addition to commanding the DC unit 82 to drive the PF motor 65 in the reverse direction, the control unit 81 also starts to read the detection voltage of the PW sensor 46 from the ASIC 42. The control unit 81 periodically stores the read detection voltage in the RAM 74. Accordingly, the RAM 74 stores a plurality of detection voltages that are successively obtained by the PW sensor 46 while the CDR tray 2 is moved into the printer 1. As shown in FIG. 5, the RAM 74 stores a detection-voltage data group 86 including the detection voltages that are successively obtained by the PW sensor 46.

Figure 8:
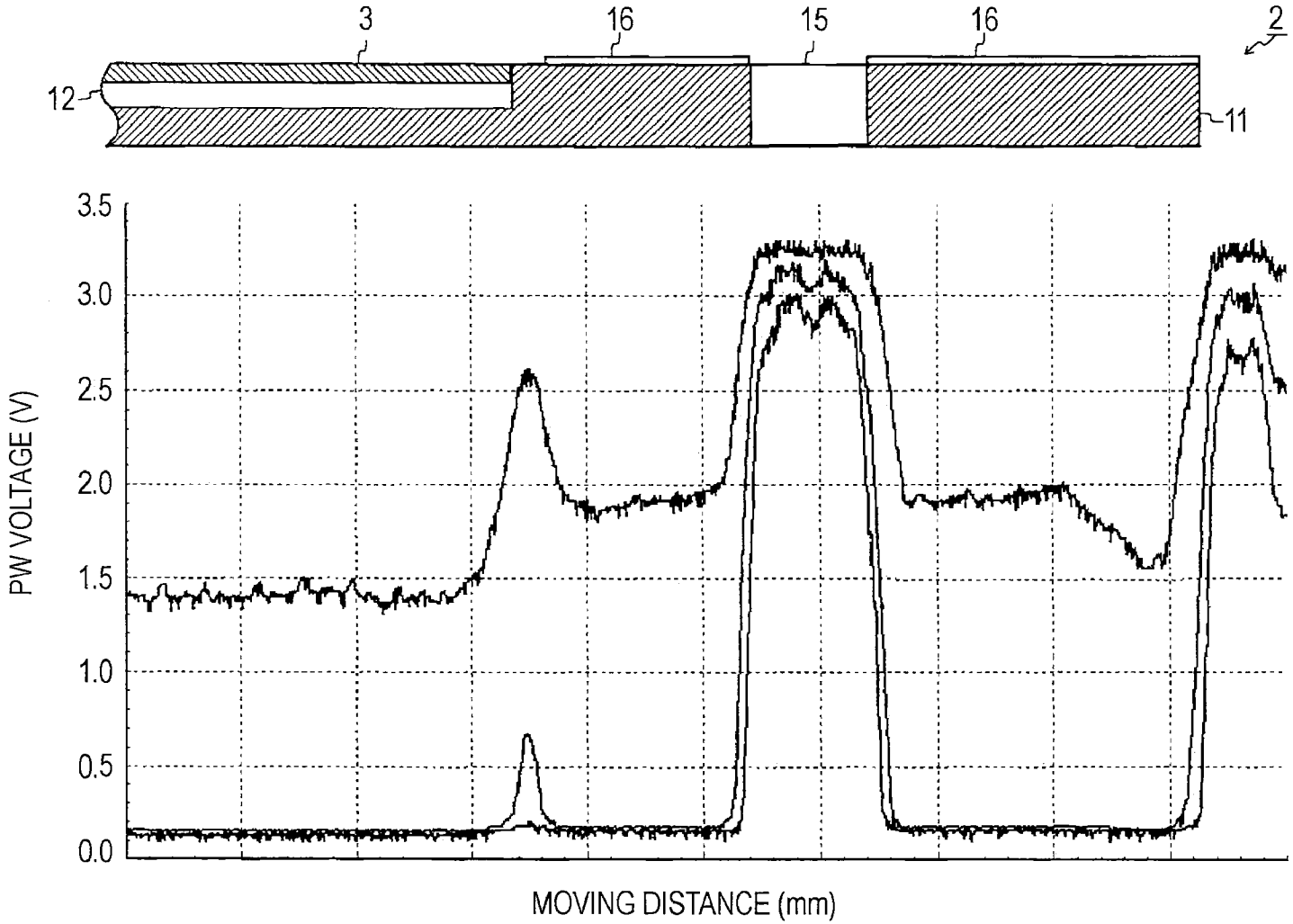
FIG. 8 is a diagram illustrating the relationship between a detection voltage waveform obtained by the PW sensor and the CDR tray.

FIG. 8 is a voltage waveform diagram showing examples of voltage waveforms based on the detection-voltage data group 86 stored in the RAM 74 shown in FIG. 5. In FIG. 8, a detection region of the CDR tray 2 detected by the PW sensor 46 is shown above the waveforms at a position corresponding to the voltage waveforms.

FIG. 8 shows three detection voltage waveforms. In FIG. 8, the detection voltage waveform at the top is obtained when the PW sensor 46 has a lowest sensitivity, the detection voltage waveform in the middle is obtained when the PW sensor 46 has a typical sensitivity, and the detection voltage waveform at the bottom is obtained when the PW sensor 46 has a highest sensitivity. As is clear from FIG. 8, the detection voltage waveform obtained by the PW sensor 46 largely varies depending on the sensitivity of the PW sensor 46.

As shown in FIG. 8, when the CDR tray 2 is moved in the reverse direction while the PW sensor 46 provided on the carriage 32 is positioned at the position shown by 'A' in FIG. 3 in the main-scanning direction, the PW sensor 46 detects the white mark section 16, the position detection hole 15, the white mark section 16, the tray body 11, and the disc-shaped medium 3, in that order. Accordingly, as shown in FIG. 8, the detection voltage from the PW sensor 46 changes from a high voltage at which the CDR tray 2 is not detected to a low voltage corresponding to the white mark section 16, a high voltage corresponding to the position detection hole 15, a low voltage corresponding to the white mark section 16, an intermediate voltage corresponding to the tray body 11, and a low voltage corresponding to the disc-shaped medium 3, in that order.

After the detection voltages obtained by the PW sensor 46 are stored, the control unit 81 commands the DC unit 82 to position the CDR tray 2 in the sub-scanning direction such that the position detection hole 15 in the CDR tray 2 and the PW sensor 46 are arranged on the same line in the main-scanning direction. Then, the control unit 81 outputs a command to move the carriage 32 in the main-scanning direction. In addition to outputting the command to move the carriage 32 in the main-scanning direction, the control unit 81 successively reads out detection voltages obtained by the PW sensor 46 from the ASIC 42 and stores the detection voltages in the RAM 74. Accordingly, the RAM 74 stores the detection-voltage data group 86 obtained by scanning the position detection hole 15 in the CDR tray 2 in the sub-scanning direction and the main-scanning direction.

After the detection-voltage data group 86 obtained by scanning the position detection hole 15 in the sub-scanning direction and the main-scanning direction with the PW sensor 46 is stored in the RAM 74, the control unit 81 calculates the center position of the CDR tray 2 on the basis of the stored detection voltages.

To calculate the center position of the CDR tray 2, first, the control unit 81 determines the center position of the position detection hole 15 in the sub-scanning direction on the basis of the detection voltage waveform in the sub-scanning direction that is stored in the RAM 74. More specifically, the control unit 81 determines the positions of two edges of the position detection hole 15 in the sub-scanning direction from two points where the voltage changes suddenly in the detection voltage waveform, and then determines the midpoint of the two points as the center position of the position detection hole 15 in the sub-scanning direction. Then, by a similar method, the control unit 81 determines the center position of the position detection hole 15 in the main-scanning direction on the basis of the detection voltage waveform in the main-scanning direction that is stored in the RAM 74.

After the center position of the position detection hole 15 is determined, the control unit 81 reads the hole position information 77 from the memory 73 and adds the hole position information 77 to the determined center position of the position detection hole 15. More specifically, the information of distance in the scanning direction of the carriage 32 (the distance x in FIG. 3) included in the hole position information 77 is added to the center position of the position detection hole 15 in the main-scanning direction. Similarly, the information of distance in the moving direction of the CDR tray 2 (the distance y shown in FIG. 3) is added to the center position of the position detection hole 15 in the sub-scanning direction.

Accordingly, the center position of the CDR tray 2 mounted in the printer 1 is determined for both the sub-scanning direction and the main-scanning direction.

In the above-described step of detecting the tray center position, the PW sensor 46 may also scan the position detection hole 15 in the main-scanning direction first and then in the sub-scanning direction. In addition, the control unit 81 may also perform the process of determining the center position of the position detection hole 15 and calculating the center position of the CDR tray 2 for each of the main-scanning direction and the sub-scanning direction independently.

After the step of detecting the tray center position, the control unit 81 performs a step of calculating a CDR discrimination threshold (Step 2).

The RAM 74 stores voltages obtained by detecting the white mark section 16 with the PW sensor 46. As shown by the detection voltage waveforms of the PW sensor 46 in FIG. 8, the detection voltage obtained by the PW sensor 46 at the disc-shaped medium 3 varies depending on the sensitivity of the PW sensor 46. In particular, when the sensitivity of the PW sensor 46 is low, the detection voltage relatively largely varies compared to the cases in which the sensitivity of the PW sensor 46 is high or typical, and a detection voltage varies by about 1 V at the disc-shaped medium 3.

In order to increase the detection accuracy of the peripheral edge of the disc-shaped medium 3, the CDR discrimination threshold is preferably set to a value close to the middle value between the detection voltage obtained by the PW sensor 46 at the disc-shaped medium 3 and the detection voltage obtained by the PW sensor 46 at the elliptical through holes 14. When the CDR discrimination threshold is set in this manner, the peripheral edge of the disc-shaped medium 3 can be accurately detected as the position where the voltage suddenly changes in the detection voltage waveform obtained by the PW sensor 46. As a result, the position determined as the peripheral edge of the disc-shaped medium 3 on the basis of data can be prevented from largely varying due to noise or the like.

In the step of calculating the CDR discrimination threshold, first, the control unit 81 selects a detection voltage obtained at the white mark section 16 from the detection voltage waveform that is obtained by the PW sensor 46 and stored in the RAM 74. For example, the control unit 81 selects the maximum detection voltage obtained at the white mark section 16 from the detection voltage waveform stored in the RAM 74. Referring to FIG. 8, if the PW sensor 46 has the lowest sensitivity, the detection voltage obtained at the white mark section 16 is, for example, 2.02 V. If the PW sensor 46 has the highest sensitivity, the detection voltage obtained at the white mark section 16 is, for example, 0.09 V.

After the detection voltage obtained at the white mark section 16 is selected, the control unit 81 calculates the CDR discrimination threshold as follows:

$$M = -0.25 \times VRH + 0.9 \text{ (when } VRH \leq 2) \quad \text{Equation 1}$$
$$= 0.4 \text{ (when } VRH > 2)$$

$$VRS - T = VRH + M \quad \text{Equation 2}$$

where VRH is the selected detection voltage that is obtained at the white mark section 16 and VRS-T is the CDR discrimination threshold.

For example, when the PW sensor 46 has the lowest sensitivity, the detection voltage obtained at the white mark section 16 is about 2.02 V. Accordingly, the control unit 81 calculates M=0.4 from Equation 1, and calculates the CDR discrimination threshold VRS-T as 2.42 V from Equation 2. When the PW sensor 46 has the lowest sensitivity, the detection voltage obtained by the PW sensor 46 at the elliptical through holes 14 is about 3.2 V, similar to the detection voltage obtained at the position detection hole 15 in FIG. 8. In addition, the detection voltage obtained at the disc-shaped medium 3 is about 1.4 V. Thus, the CDR discrimination threshold VRS-T is close to the middle value between these voltages.

In addition, when the PW sensor 46 has a typical sensitivity, the detection voltage obtained at the white mark section 16 is about 0.12 V. Accordingly, the control unit 81 calculates M=0.87 from Equation 1, and calculates the CDR discrimination threshold VRS-T as 0.99 V from Equation 2. When the PW sensor 46 has a typical sensitivity, the detection voltage obtained by the PW sensor 46 at the elliptical through holes 14 is about 3.0 V, similar to the detection voltage obtained at the position detection hole 15 in FIG. 8. In addition, the detection voltage obtained at the disc-shaped medium 3 is about 0.1 V. Thus, the CDR discrimination threshold VRS-T is close to the middle value between these voltages.

In addition, when the PW sensor 46 has the highest sensitivity, the detection voltage obtained at the white mark section 16 is about 0.09 V. Accordingly, the control unit 81 calculates M=0.8775 from Equation 1, and calculates the CDR discrimination threshold VRS-T as 0.9675 V from Equation 2. When the PW sensor 46 has the highest sensitivity, the detection voltage obtained by the PW sensor 46 at the elliptical through holes 14 is about 2.8 V, similar to the detection voltage obtained at the position detection hole 15 in FIG. 8. In addition, the detection voltage obtained at the disc-shaped medium 3 is about 0.08 V. Thus, the CDR discrimination threshold VRS-T is close to the middle value between these voltages.

As described above, when the CDR discrimination threshold VRS-T is determined on the basis of Equations 1 and 2, the CDR discrimination threshold can be set to a value close to an approximately middle value between the detection voltage obtained by the PW sensor 46 at the disc-shaped medium 3 and the detection voltage obtained by the PW sensor 46 at the elliptical through holes 14.

After the step of calculating the CDR discrimination threshold, the control unit 81 performs a step of detecting a medium center position using the CDR discrimination threshold (Step 3).

The medium center position is the position of the center of the disc-shaped medium 3 that is mounted in the printer 1.

In the step of detecting the medium center position, first, the control unit 81 commands the DC unit 82 to drive the CR motor 64. Accordingly, the DC unit 82 and the CR motor driver 62 drive the CR motor 64 until the PW sensor 46 reaches the position shown by 'B' in FIGS. 3 and 5 in the main-scanning direction. At this time, the control unit 81 may designate the center position of the CDR tray 2 in the main-scanning direction, which is detected in the step of detecting the tray center, as the set position of the PW sensor 46.

After the PW sensor 46 is positioned at the position shown by 'B' in the main-scanning direction in FIGS. 3 and 5, the control unit 81 commands the DC unit 82 to drive the PF motor 65 and stores detection voltages obtained by the PW sensor 46 in the RAM 74. Accordingly, a detection voltage waveform obtained by scanning a region from the elliptical through hole 14 at the top in FIG. 3 to the elliptical through hole 14 at the bottom with the PW sensor 46 is stored in the RAM 74.

When, for example, the disc-shaped medium 3 having a diameter of 12 cm is placed in the circular recess 12, the detection voltage obtained by the PW sensor 46 changes from a high voltage corresponding to the elliptical through hole 14 at the top in a central region in FIG. 3 to a low voltage corresponding to the disc-shaped medium 3, a voltage corresponding to the chuck portion 13, a low voltage corresponding to the disc-shaped medium 3, and a high voltage corresponding to the elliptical through hole 14 at the bottom in the central region in FIG. 3, in that order.

After the detection voltage waveform obtained by the PW sensor 46 at the central region in FIG. 3 is stored in the RAM 74, the control unit 81 detects the positions of the ends of the disc-shaped medium 3. More specifically, the control unit 81 compares the stored detection voltage waveform with the CDR discrimination threshold and determines the ends of an area where the voltage is equal to or less than the CDR discrimination threshold as opposite ends of the disc-shaped medium 3. Then, the control unit 81 calculates the middle position between the two ends and determines the middle position as the center position of the disc-shaped medium 3 mounted in the printer 1 in the sub-scanning direction.

After the center position of the disc-shaped medium 3 in the sub-scanning direction is determined, the control unit 81 commands the DC unit 82 to drive the PF motor 65. The DC unit 82 and the PF motor driver 63 drive the PF motor 65 such that the position of the CDR tray 2 in the sub-scanning direction (position denoted by 'C' in FIG. 3) coincides with the detection position of the PW sensor 46 (see FIG. 1). At this time, the control unit 81 may designate a position where the center position of the CDR tray 2 in the sub-scanning direction (position denoted by 'C' in FIG. 3), which is detected in the step of detecting the tray center, coincides with the detection position of the PW sensor 46 as the set position of the CDR tray 2 (see FIG. 1).

After the CDR tray 2 is positioned such that the position denoted by 'C' in FIG. 3 in the sub-scanning direction coincides with the detection position of the PW sensor 46, the control unit 81 commands the DC unit 82 to drive the CR motor 64 and stores detection voltages obtained by the PW sensor 46 in the RAM 74. Accordingly, a detection voltage waveform obtained by scanning a region from the elliptical through hole 14 at the left-most position in FIG. 3 to the elliptical through hole 14 at the right-most position with the PW sensor 46 is stored in the RAM 74.

When, for example, the disc-shaped medium 3 having a diameter of 12 cm is placed in the circular recess 12, the detection voltage obtained by the PW sensor 46 changes from a high voltage corresponding to the elliptical through hole 14 at the left-most position in FIG. 3 to a low voltage corresponding to the disc-shaped medium 3, a voltage corresponding to the chuck portion 13, a low voltage corresponding to the disc-shaped medium 3, and a high voltage corresponding to the elliptical through hole 14 at the right-most position in FIG. 3, in that order.

After the detection voltage waveform in the main-scanning direction obtained by the PW sensor 46 is stored in the RAM 74, the control unit 81 detects the positions of the ends of the disc-shaped medium 3. More specifically, the control unit 81 compares the stored detection voltage waveform with the CDR discrimination threshold and determines the ends of an area where the voltage is equal to or less than the CDR discrimination threshold as opposite ends of the disc-shaped medium 3. Then, the control unit 81 calculates the middle position between the two ends and determines the middle position as the center position of the disc-shaped medium 3 mounted in the printer 1 in the main-scanning direction.

Accordingly, the center position of the disc-shaped medium 3, which is mounted in the printer 1 using the CDR tray 2, is determined for both the main-scanning direction and the sub-scanning direction.

After the step of detecting the medium center position, the control unit 81 performs a step of calculating a distance between the tray center position and the medium center position (Step 4). Then, depending on the calculated distance, the control unit 81 selects one of the tray center position and the medium center position as a disc center position to be used in print control (Step 5).

With regard to the shape of the disc-shaped medium 3, in addition to the above-described circular plate shape having a diameter of 12 cm or 8 cm, the disc-shaped medium 3 may also have, for example, a shape obtained by cutting off opposite ends of a circular plate along parallel lines. In addition, the disc-shaped medium 3 may have a print surface in a partial region thereof, and characters or symbols identifying the manufacturer of the disc-shaped medium 3 may be printed on the print surface of the disc-shaped medium 3.

If disc-shaped media having various shapes and designs are optically scanned with the PW sensor 46 and the center positions thereof are determined by comparing the obtained optical detection voltage waveforms with the CDR discrimination threshold, there is a risk that the determined center positions will be largely displaced from the tray center position. If the print position is adjusted on the basis of a medium center position that is displaced from the tray center position, there is a risk that the printed image will be largely displaced and protrude from the disc-shaped medium 3.

Accordingly, the control unit 81 determines that the disc-shaped medium 3 having a special shape or the like is mounted if the distance between the tray center position and the medium center position is equal to or larger than a predetermined distance. In such a case, in order to prevent the above-described displacement, the tray center position is selected as the disc center position to be used in print control. If the distance between the tray center position and the medium center position is smaller than the predetermined distance, the control unit 81 selects the medium center position, that is, the center position of the disc-shaped medium 3 to be printed on, as the disc center position to be used in print control. Accordingly, the printed image is positioned as accurately as possible relative to the disc-shaped medium 3. Therefore, the printed image is prevented from being largely displaced or protruding from the disc-shaped medium 3.

After the disc center position to be used in print control is selected, the control unit 81 starts the process of printing on the disc-shaped medium 3 using the print data by the communication I/F from the host computer 4. The control unit 81 commands the DC unit 82 to control the printing process such that the center of the image based on the print data coincides with the selected center position (Step 6).

The DC unit 82 and the PF motor driver 63 drive the PF motor 65 so as to position an end of the disc-shaped medium 3 on the CDR tray 2 in the sub-scanning direction to the print area. At this time, the DC unit 82 and the PF motor driver 63 adjust the stop position on the basis of the disc center position in the sub-scanning direction.

Then, the DC unit 82 and the CR motor driver 62 drive the CR motor 64 so as to move the carriage 32 at a constant velocity. The DC unit 82 and the recording-head control circuit 61 adjust the ink ejection timing on the basis of the disc center position in the main-scanning direction and cause the recording head 34 to eject the ink from the ink-ejecting nozzles 35 in accordance with the print data.

Accordingly, the ink is applied to the disc-shaped medium 3 placed in the print area over a region having a width corresponding to a single scan of the carriage 32. More specifically, for example, the ink is applied to the disc-shaped medium 3 in a region having a width corresponding to the width of the region where the ink-ejecting nozzles 35 are arranged in the sub-scanning direction.

When the ink ejection control for the region positioned at the print area is finished, the DC unit 82 and the PF motor driver 63 drive the PF motor 65 so as to move the disc-shaped medium 3 in the sub-scanning direction by a predetermined distance. Then, the carriage 32 is moved at a constant velocity by the DC unit 82 and the CR motor driver 62. At the same time, the DC unit 82 and the recording-head control circuit 61 cause the recording head 34 to eject the ink from the ink-ejecting nozzles 35 in accordance with the print data.

The DC unit 82, the PF motor driver 63, the CR motor driver 62, and the recording-head control circuit 61 repeatedly perform the control of moving the disc-shaped medium 3 in the sub-scanning direction to a stop position adjusted on the basis of the disc center position and the control of ejecting the ink at the ink ejection timing adjusted on the basis of the disc center position until all of the print data is processed. Then, after all of the print data is processed, the DC unit 82 and the PF motor driver 63 eject the disc-shaped medium 3 to the paper output tray 30 together with the CDR tray 2.

According to the above-described printing process, the printer 1 prints an image or the like based on the print data on the disc-shaped medium 3 placed on the CDR tray 2. More specifically, the control unit 81 determines the center position of the disc-shaped medium 3 on the CDR tray 2 and performs the printing process such that the center of the image based on the print data coincides with the disc center position. Therefore, the image or the like based on the print data can be printed at an accurate position in the print area of the disc-shaped medium 3, which is mounted in the printer 1 together with the CDR tray 2, without being displaced or protruding from the print area.

In the present embodiment, the white mark section 16 provided on the CDR tray 2 has a reflectance of about 80%. The PW sensor 46 included in the printer 1 scans the white mark section 16 before the center position of the disc-shaped medium 3 is detected, and the control unit 81 sets the CDR discrimination threshold on the basis of the detection voltage obtained at the white mark section 16. Therefore, even when the sensitivity of the PW sensor 46 differs for each printer, the periphery of the disc-shaped medium 3 can be accurately determined without being influenced by the difference in sensitivity.

According to the present embodiment, the reflectance of the white mark section 16 is about 80%. In general, the print area of the disc-shaped medium 3 placed on the CDR tray 2 has a reflectance of about 80% or more even when the print area has a mat, white surface. Therefore, the detection voltage obtained by the PW sensor 46 at the white mark section 16 is associated with the detection voltage obtained by the PW sensor 46 at the disc-shaped medium 3 at a similar level. According to the present embodiment, the detection voltage obtained by the PW sensor 46 is largely reduced as the amount of received light is increased. If the reflectance of the white mark section 16 is in the range of 65% to 95%, the detection voltage obtained at the white mark section 16 is associated with the detection voltage obtained at the disc-shaped medium 3 at a similar level.

The control unit 81 determines the CDR discrimination threshold by adding a value equal to or more than 0.4 V to a voltage obtained by detecting the white mark section 16 with the PW sensor 46. Then, the CDR discrimination threshold is used to distinguish the detection voltage obtained by the PW sensor 46 when no light is received from the detection voltage obtained at the medium.

Accordingly, the CDR discrimination threshold varies in accordance with the detection voltage obtained by the PW sensor 46 at the white mark section 16. Therefore, even when the sensitivity of the PW sensor 46 differs for each printer 1, the detection voltage obtained at the elliptical through holes 14 formed in the CDR tray 2 can be distinguished from the detection voltage obtained at the disc-shaped medium 3 using the CDR discrimination threshold. Thus, the position and the area of the disc-shaped medium 3 can be determined.

In addition, when a voltage of 0.4 V is added, the difference between the CDR discrimination threshold and the detection signal obtained by the PW sensor 46 at the disc-shaped medium 3 is set to 0.4 V or more. As a result, even when the PW sensor 46 used in the printer 1 has a low sensitivity and a voltage difference between the detection voltage obtained at the disc-shaped medium 3 and the detection voltage obtained at the elliptical through holes 14 is low, the disc-shaped medium 3 placed on the CDR tray 2 can be determined using the CDR discrimination threshold having a necessary and sufficient difference.

In addition, if the detection voltage obtained by the PW sensor 46 at the white mark section 16 is 2 V or less, the control unit 81 adds a voltage larger than 0.4 V to the detection voltage obtained by the PW sensor 46 at the white mark section 16. More specifically, a voltage of 0.9 V is added at a maximum. The value added to the detection voltage obtained by the PW sensor 46 at the white mark section 16 is increased as the sensitivity of the PW sensor 46 is increased. Therefore, even when the PW sensor 46 has a high sensitivity and the detection voltage obtained by the PW sensor 46 at the white mark section 16 is maintained at a low level instead of varying in accordance with the amount of light received by the PW sensor 46, the CDR discrimination threshold can be set to an adequate value between the detection voltage obtained at the elliptical through holes 14 and the detection voltage obtained at the medium.

The white mark section 16 is provided on the same side of the CDR tray 2 as the side on which the circular recess 12 is formed. When the printing process is performed, the PW sensor 46 optically detects the white mark section 16 on the CDR tray 2 mounted in the printer 1, and then optically detects the center position of the disc-shaped medium 3. Therefore, it is not necessary for the user to reverse the CDR tray 2 for the optical detection of the white mark section 16.

In addition, the rectangular position detection hole 15 that is accurately positioned relative to the chuck portion 13 is formed at the center of the white mark section 16, which is formed on the same side of the CDR tray 2 as the side on which the circular recess 12 is formed. Two opposite sides of the rectangle are substantially parallel to the moving direction of the CDR tray 2, and the other two opposite sides of the rectangle are substantially parallel to the scanning direction of the carriage 32. The control unit 81 selects the positions of the four sides of the position detection hole 15 from the detection voltage waveforms obtained by scanning the position detection hole 15 with the PW sensor 46, and determines the center position based on the positions of the four sides. Then, the control unit 81 determines the center position of the CDR tray 2 by adding the hole position information 77 to the determined center position of the position detection hole 15.

Accordingly, the detection voltage at the white mark section 16 used for setting the CDR discrimination threshold and the voltage waveform used for detecting the position of the CDR tray 2 mounted in the printer 1 can be obtained by a single scan of the white mark section 16 by the PW sensor 46. Therefore, the CDR discrimination threshold can be set and the position of the CDR tray 2 mounted in the printer 1 can be detected on the basis of a single scan performed by the PW sensor 46. The position detection hole 15 may also be formed along the outer edge of the white mark section 16, instead of being formed in the white mark section 16.

The above-described embodiment is simply an example of a preferred embodiment of the invention, and the invention is not limited to the above-described embodiment. In other words, various modifications and changes are possible within the scope of the invention.

For example, in the above-described embodiment, the control unit 81 calculates the CDR discrimination threshold from the detection voltage obtained by the PW sensor 46 at the white mark section 16 using Equations 1 and 2. However, the control unit 81 may also calculate the CDR discrimination threshold by multiplying the detection voltage obtained by the PW sensor 46 at the white mark section 16 by a predetermined multiplier, such as '2'. In addition, instead of using a predetermined multiplier, a multiplier determined in accordance with the detection voltage obtained by the PW sensor 46 at the white mark section 16 may also be used. In addition, the control unit 81 may also determine the CDR discrimination threshold to be used by referring to a table indicating the relationship between the detection voltage obtained by the PW sensor 46 at the white mark section 16 and the CDR discrimination threshold.

In the above-described embodiment, the white mark section 16 having a predetermined reflectance is provided on the CDR tray 2 to calculate the CDR discrimination threshold. However, mark sections in other colors, such as silver and yellow, may also be formed on the CDR tray 2.

In the above-described embodiment, the white mark section 16 is formed at a position near an edge of the CDR tray 2 in the transporting direction thereof. However, the white mark section 16 may also be formed on, for example, the chuck portion 13 of the CDR tray 2 as long as the white mark section 16 is not placed in an area where the disc-shaped medium 3 is placed.

In the above-described embodiment, the white mark section 16 is used also as a mark for detecting the tray center position. However, a plurality of white mark sections similar to the white mark section 16 may be provided on the CDR tray 2 at symmetric positions about the center position of the chuck portion 13, and be detected to determine the tray center position.

In the above-described embodiment, the control unit 81 detects both the tray center position and the medium center position, and selects one of the detected center positions as the medium center position used for adjusting the print position. However, the structure may also be such that only one of the tray center position and the medium center position is detected and used for adjusting the print position.

In the above-described embodiment, the disc-shaped medium 3 is placed on the detachable CDR tray 2 and is subjected to printing. However, other kinds of media having various shapes, such as a shape obtained by cutting off opposite ends of a circular plate along parallel lines and a rectangular shape, may also be placed on the detachable CDR tray 2 and be printed on. In addition, although the disc-shaped medium 3 is placed on the CDR tray 2 in a horizontal orientation, the CDR tray 2 may also be held in a vertical orientation. In addition, the disc-shaped medium 3 may also be held by being inserted in a bag-shaped tray.

In the above-described embodiment, ink is ejected toward the disc-shaped medium 3. Accordingly, the printer 1 is an ink jet printer. However, the printer 1 may also be a laser printer, a photo printer, or other kinds of printing apparatuses.

The invention may be applied to printers for printing on media like CD-R discs.

In addition, although a printer is described as an example in the above-described embodiment, the invention may also be applied to other kinds of liquid-ejecting apparatuses that eject liquid on the basis of liquid ejection data.

The liquid ejecting apparatus may be used in medical applications, color film manufacturing, etc.

What is claimed is:

1. A liquid-ejecting apparatus comprising:

a tray having a hole;

a mark section provided in an area adjacent to the hole;

a boundary section located between the hole and the mark section;

a sensor detecting the boundary section; and a controller executing control of liquid ejection based on liquid ejection data, wherein the liquid-ejecting apparatus determines a reference position in the hole on the basis of the boundary section and ejects liquid on the basis of information including the reference position, wherein the boundary section is determined on the basis of a threshold and a voltage obtained by the sensor, wherein the threshold is calculated on the basis of the voltage obtained by the sensor at the boundary section, wherein the threshold is set such that the reference position can be accurately determined even if the voltage is influenced by noise, wherein the threshold is calculated by adding or subtracting a predetermined value to or from the voltage obtained by the sensor at the mark section.

2. The liquid-ejecting apparatus as set forth in claim 1 wherein the predetermined value varies in accordance with the voltage obtained by the sensor.

3. A liquid-ejecting method, comprising:

detecting a position of a boundary section between a hole in a tray and a mark section provided in an area adjacent to the hole with a sensor;

determining a reference position in the hole on the basis of the position of the boundary section;

determining, on the basis of information including the reference position, a center position of an area for placing an object toward which liquid is ejected;

determining, on the basis of information including the reference position, a center position of the object;

calculating a distance between the center position of the area for placing the object and the center position of the object;

ejecting the liquid such that the center of image data, on the basis of which the liquid is ejected toward the object, coincides with the center position of the area for placing the object if the distance is equal to or more than a predetermined distance;

and ejecting the liquid such that the center of the image data coincides with the center position of the object if the distance is less than the predetermined distance, wherein the position of the boundary section is determined on the basis of a threshold and a voltage obtained by the sensor and wherein the threshold is calculated by adding or subtracting a predetermined value to or from a voltage obtained by the sensor at the mark section.

4. The liquid-ejecting method as set forth in claim 3, wherein the predetermined value varies depending on the voltage of the sensor.

* * * * *